US005870991A

United States Patent [19]

Mineno

[11] Patent Number: 5,870,991

[45] Date of Patent: Feb. 16, 1999

[54] LUBRICATING DEVICE FOR OUTBOARD MOTOR

[75] Inventor: Kazuo Mineno, Hamamatsu, Japan

[73] Assignee: Suzuki Kabushiki Kaisha, Hamamatsu, Japan

[21] Appl. No.: 15,511

[22] Filed: Jan. 29, 1998

[30] Foreign Application Priority Data

Jan. 31, 1997 [JP] Japan ..... 9-019464

[51] Int. Cl.[6] ..... F01N 1/00

[52] U.S. Cl. ..... 123/196 R; 123/196 W; 184/6.18; 440/88

[58] Field of Search ..... 123/196 R, 196 W; 184/6.18; 440/88

[56] References Cited

U.S. PATENT DOCUMENTS

| | | | |
|---|---|---|---|
| 4,562,797 | 1/1986 | Suzuki | 123/90.34 |
| 4,664,228 | 5/1987 | Hashigaki et al. | 184/6.5 |
| 4,802,871 | 2/1989 | Watanabe et al. | 123/196 W |
| 4,911,119 | 3/1990 | Ohno et al. | 440/75 |
| 5,215,164 | 6/1993 | Shibata | 184/6.13 |
| 5,514,015 | 5/1996 | Okazawa et al. | 440/88 |
| 5,653,205 | 8/1997 | Ozeki | 123/195 C |
| 5,687,688 | 11/1997 | Tsunoda et al. | 123/196 W |

*Primary Examiner*—Henry C. Yuen
*Assistant Examiner*—Hai Huynh
*Attorney, Agent, or Firm*—Finnegan, Henderson, Farabow, Garrett & Dunner, L.L.P.

[57] ABSTRACT

An outboard motor comprises an engine of vertical type in which a crank shaft is disposed vertically in an installed state of the engine, an engine holder supporting the engine, an oil pan which is disposed below the engine through the engine holder and in which an oil is accumulated, and a lubricating device for lubricating the oil from the oil pan to an inside of the engine. The lubricating device comprises an oil pump mounted to a lower side portion of the engine holder and adapted to suck the oil accumulated in the oil pan, an oil suction passage and an oil discharge passage. The oil suction passage and oil discharge passage extend in parallel to each other from the oil pump and are formed integrally with an inside portion of the engine holder.

7 Claims, 10 Drawing Sheets

LUBRICATING DEVICE FOR OUTBOARD MOTOR

BACKGROUND OF THE INVENTION

The present invention relates to an outboard motor and, more particularly, a device for lubricating an inside portion of an engine unit of an outboard motor with oil.

An outboard motor has an engine unit mounted vertically in such a way that the crank shaft of the engine is vertically disposed. The engine is formed by assembling a crank case, a cylinder block, a cylinder head and the like. If the engine is a four-stroke-cycle engine, an oil pan is disposed below the engine. A lubricating device having an oil pump for pumping up oil accumulated in the oil pan is provided to lubricate the inside portion of the engine.

As a conventional lubricating device for an outboard motor, the following lubricating devices have been provided as disclosed in, for example, Japanese Patent Laid-Open Publication No. HEI 8-100614 (hereinafter called a "first conventional example"), Japanese Patent Publication No. 2516024 (hereinafter called a "second conventional example"), Japanese Patent Laid-Open Publication No. HEI 7-94803 (hereinafter called a "third conventional example") and Japanese Patent Laid-Open Publication No. HEI 3-38156 (hereinafter called a "fourth conventional example").

The lubricating device according to the first conventional example has a structure in which an oil pan is attached below a cylinder block and a cylinder head. An oil pump is disposed below the cylinder head in the oil pan 88, and the oil pump is operated by a cam shaft rotatably supported in the cylinder head.

The lubricating device according to the second conventional example has a structure in which an oil pan is attached below a cylinder block. An oil pump is disposed below a cylinder head which serves as the outer surface of the oil pan so that the oil pump is operated by a cam shaft. An oil discharge passage extending from the oil pump is formed in the core portion of the cam shaft and the inside portions of the cylinder block and the cylinder block. An oil-pressure control valve is disposed in a portion in which the oil discharge passage passes through the inside portion of the cylinder block. An oil strainer connected to the suction portion of the oil pump is attached to the lower surface of the cylinder block.

The lubricating device according to the third conventional example has a similar structure in which an oil pump is disposed below a cylinder head at a position on the outside of the oil pan. Thus, the oil pump is operated by a cam shaft. In this example, oil suction passages extending from the oil pump and oil returning passages for returning, to the oil pan, oil supplied to the inside portion of the cylinder head are formed from the cylinder head to a cylinder block. A hose for returning oil extends from the head cover, the hose being joined to the oil returning passage. Moreover, an oil strainer is attached to the lower surface of the cylinder block.

The lubricating device according to the fourth conventional example has a structure in which an oil pump disposed on the lower surface of a cylinder head is operated by a cam shaft. An oil discharge passage extending from the oil pump is formed from the cylinder head to a cylinder block. An oil-pressure control valve connected to an intermediate position of the oil discharge passage is disposed on the lower surface of a plate secured to the lower surface of the engine.

However, the conventional lubricating devices for the outboard motors according to the above-mentioned four conventional examples suffer from the following problems.

Since each of the lubricating devices for an outboard motor has the structure in which the oil pump is disposed on the lower surface of the engine, when the engine is solely removed from the outboard motor for maintenance thereof or the like, it is removed with the oil pump projecting over the lower portion of the engine. Thus, there is a possibility that the oil pump is broken attributable to an external factor. Moreover, the engine cannot be placed on a flat workbench to perform the maintenance. Thus, the maintenance cannot easily be performed.

The lubricating devices according to the second and third conventional examples are structured such that the oil suction passage and the oil discharge passage extending from the oil pump are formed in the cylinder head and the cylinder block of the engine. Therefore, the structure of a mold for casting each of the cylinder head and the cylinder block becomes too complicated to easily manufacture the engine. In particular, the lubricating device according to the third conventional example has the oil returning passages formed in the cylinder head and the cylinder block in addition to the oil suction passages. Moreover, the hose extending from the head cover is joined to the oil returning passage. Therefore, it is more difficult to manufacture the engine of this type, and the size of the engine cannot easily be reduced.

The lubricating device according to the second conventional example has the structure in which the oil-pressure control valve is disposed, together with the oil pump, on the lower surface of the engine. Therefore, when the engine is solely removed from the outboard motor, the oil-pressure control valve may be broken as well as the oil pump. Since the lubricating device according to the fourth conventional example has the structure in which the oil-pressure control valve is disposed on the lower surface of a plate secured to the lower surface of the engine, the oil-pressure control valve cannot be broken when the engine is solely removed in such a manner that the plate is left. However, the oil-pressure control valve may be broken when the engine is removed together with the plate.

The lubricating devices according to the second and third conventional examples have the structure in which the corresponding oil strainers are attached to the lower surfaces of the cylinder blocks. Therefore, the oil strainers must be removed for the purpose of preventing breakage when the engine is removed solely. Therefore, the maintenance easiness further deteriorates.

The lubricating devices according to the second and fourth conventional examples have the structure in which each of the oil discharge passages extending from the oil pumps penetrates a junction between the cylinder head and the cylinder block. Moreover, each of the oil-pressure control valves is disposed in the downstream portion of each of the oil discharge passages. Therefore, there is a possibility that oil leakage takes place from the oil discharge passages in the junction between the cylinder head and the cylinder block.

SUMMARY OF THE INVENTION

A primary object of the present invention is to substantially eliminate defects or drawbacks encountered in the prior art mentioned hereinbefore and to provide a lubricating device for an outboard motor which is capable of preventing breakage of an oil pump when an engine is solely removed from the outboard motor, enabling maintenance of the engine to be performed easily and preventing the oil pump from drying, and introduction of foreign matter after the engine has been removed in order to elongate the life of the outboard motor, easily manufacture the engine and reduce the size of the engine.

Another object of the present invention is to provide a lubricating device for an outboard motor which enables an oil suction passage and an oil discharge passage of an oil pump to be formed easily.

A further object of the present invention is to provide a lubricating device for an outboard motor which is capable of preventing breakage of an oil strainer when the engine is solely removed from the outboard motor.

A still further object of the present invention is to provide a lubricating device for an outboard motor which is capable of preventing breakage of an oil pressure control valve when the engine is solely removed, capable of preventing breakage of the oil pressure control valve and enabling maintenance to be performed easily also when a part provided with the oil pressure control valve is solely maintained and preventing leakage of oil from an oil discharge passage in the oil pump.

A still further object of the present invention is to provide a lubricating device for an outboard motor which is capable of effectively preventing removal of an oil pressure control valve with a simple structure to enable the lubricating apparatus to be operated normally.

A still further object of the present invention is to provide a lubricating device for an outboard motor which is capable of quickly returning oil supplied to the inside portion of the engine to the oil pan while the inner structure of the engine is formed simply.

A still further object of the present invention is to provide an outboard motor having a lubricating device having an improved structure mentioned above.

These and other objects can be achieved according to the present invention by providing, in one aspect, a lubricating device for an outboard motor in which an engine is vertically mounted in an installed state so that a crank shaft of the engine is disposed vertically, an engine holder and an oil pan are secured to a lower portion of the engine, and an oil accumulated in the oil pan is supplied to the engine, the lubricating device for an outboard motor comprising an oil pump mounted to a lower side portion of the engine holder in an installed state of the outboard motor and adapted to suck the oil accumulated in the oil pan, an oil suction passage and an oil discharge passage, the oil suction passage and oil discharge passage extending from the oil pump and being formed integrally with an inside portion of the engine holder.

In preferred embodiments, the oil suction passage and the oil discharge passage are disposed in parallel to each other in the engine, the oil pump having a drive shaft extending outward between the oil suction passage and the oil discharge passage. The oil suction passage has an inlet portion connected to an oil strainer which is secured to the lower surface of the engine holder.

An oil-pressure control valve is provided for the oil discharge passage, the oil-pressure control valve being disposed on the lower surface of the engine holder in an inclined manner so as to prevent the oil-pressure control valve from projecting over a joint surface which is the lower surface of the engine holder. The oil strainer has a support leg, which is bent to prevent the oil pressure control valve from falling down. The engine holder is integrally formed with a bore-shaped oil returning passages for returning the oil supplied into the inside portion of the engine to the oil pan.

In another aspect of the present invention, there is provided an outboard motor comprising:

an engine of vertical type in which a crank shaft is disposed vertically in an installed state of the engine;

an engine holder supporting the engine;

an oil pan which is disposed below the engine through the engine holder and in which an oil is accumulated; and a lubricating device for lubricating the oil from the oil pan to an inside of the engine, the lubricating device comprising an oil pump mounted to a lower side portion of the engine holder and adapted to suck the oil accumulated in the oil pan, an oil suction passage and an oil discharge passage, the oil suction passage and oil discharge passage extending in parallel to each other from the oil pump and being formed integrally with an inside portion of the engine holder.

According to the characteristic features of the present invention mentioned above, when the oil pump is provided on the lower portion of the engine holder secured to the lower portion of the engine, the oil pump is left in the engine holder after the engine has been solely removed from the outboard motor. Therefore, breakage of the oil pump can be prevented. Since the oil pump does not project over the lower surface of the engine, the engine can be placed on a flat workbench and the maintenance can thus easily be performed. Since the oil pump is not exposed to the outside and left in the oil pan after the engine has been removed, drying of the oil pump and introduction of foreign matter into the oil pump can be prevented. Thus, the life of the oil pump can be elongated.

Since the oil suction passage and the oil discharge passage extending from the oil pump are formed integrally in the engine holder, the necessity of forming the foregoing oil passages in the cylinder head and the cylinder block of the engine of the outboard motor as has been required for the conventional outboard motor can be eliminated. Therefore, the engine can easily be manufactured. Since the size of the engine holder is not substantially enlarged despite the provision of the oil suction passage and the oil discharge passage, the size and weight of the engine can significantly be reduced.

When the oil suction passage and the oil discharge passage are formed in parallel in the engine holder in such a manner that the drive shaft of the oil pump is interposed between the oil suction passage and the oil discharge passage, the oil suction passage and the oil discharge passage can significantly easily be formed by machining.

When the oil strainer is secured to the lower surface of the engine holder, the oil strainer is left in the engine holder after the engine has been removed from the outboard motor. Therefore, breakage of the oil strainer can be prevented.

When the oil-pressure control valve is provided for the engine holder, the oil-pressure control valve is left in the engine holder after the engine has solely been removed from the outboard motor. Therefore, breakage of the oil-pressure control valve can be prevented. When the engine holder, which is the part provided with the oil-pressure control valve, is solely removed from the outboard motor, the oil-pressure control valve does not project over the lower joint surface of the engine holder. Therefore, the oil-pressure control valve is not broken even if the engine holder is as it is placed on a workbench or the like. Since the oil-pressure control valve is provided for the oil discharge passage formed integrally with the engine holder and the oil discharge passage has no seam at an intermediate portion thereof, oil leakage from the oil discharge passage can be prevented.

When the portion for preventing falling-down of the oil-pressure control valve is formed by bending the support leg of the oil strainer, separation of the oil-pressure control valve can be prevented by the portion for preventing the separation of the oil strainer even if the oil-pressure control valve is loosen. Therefore, the lubricating device can normally be operated with a simple structure without pressure reduction.

When the lubricating device for an outboard motor is formed as described above, the necessity of forming a portion for only returning oil in the cylinder head and the cylinder block of the engine can be eliminated. Therefore, oil supplied into the engine can quickly be returned to the oil pan while the internal structure of the engine is formed simply.

Still furthermore, an outboard motor provided with such lubricating device of the characters mentioned above can attain the improved functions as an outboard motor.

The outboard motor provided with such improved lubricating device can attain effective functions when driven.

The nature and further features and advantages of the present invention will be made clear from the following detailed description of the preferred embodiments made with reference to the accompanying drawings.

DESCRIPTION OF THE PREFERRED EMBODIMENTS

Figure 1:
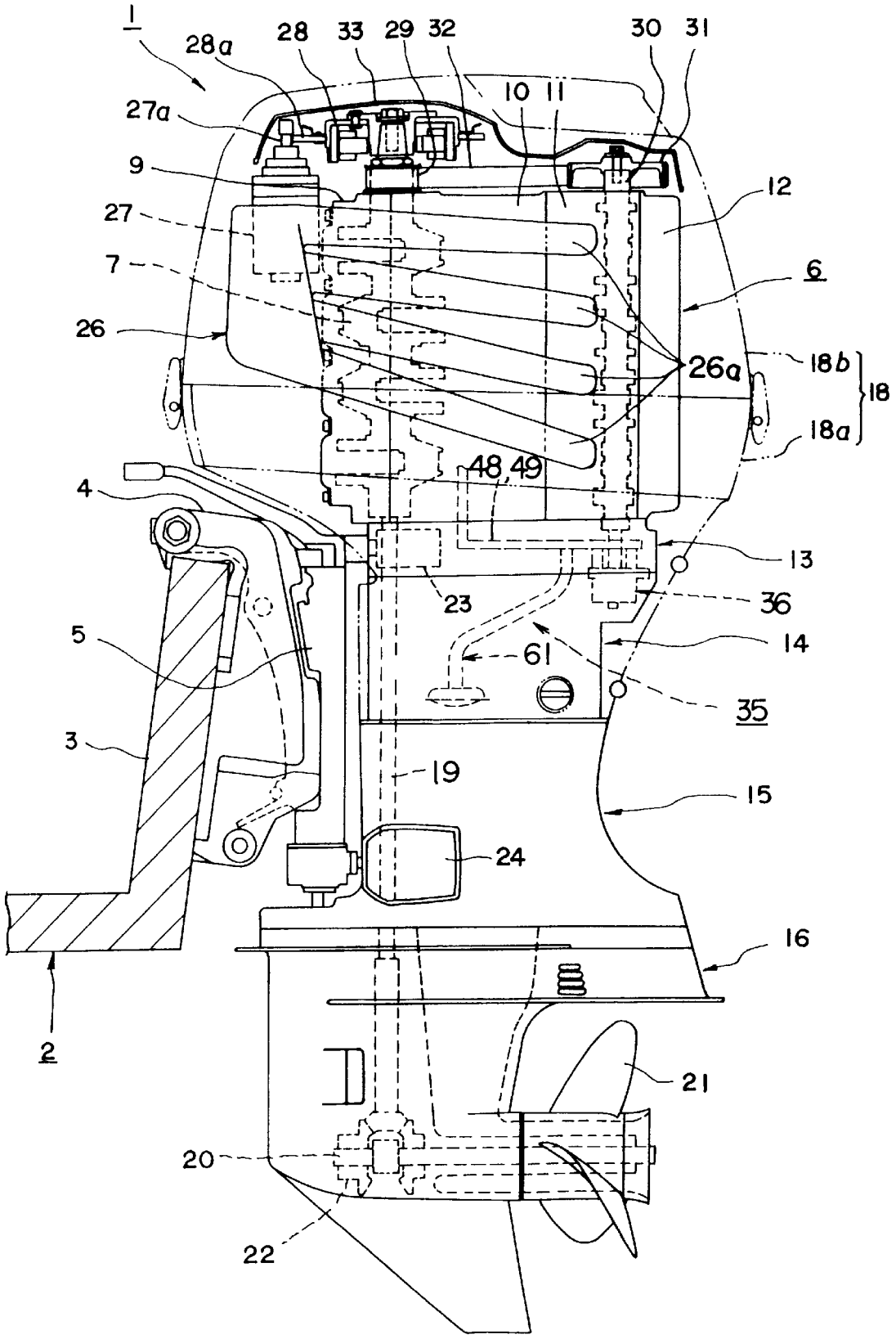
FIG. 1 is a left side view showing an outboard motor according to an embodiment of the present invention.

One preferred embodiment of the present invention will be described hereunder with reference to the accompanying drawings.

An outboard motor 1 is mounted on a transom 3 of a hull 2 through a clamp bracket 4. The outboard motor 1 is able to turn horizontally about a swivel shaft 5 vertically disposed in the rear portion of the clamp bracket 4.

Figure 2:
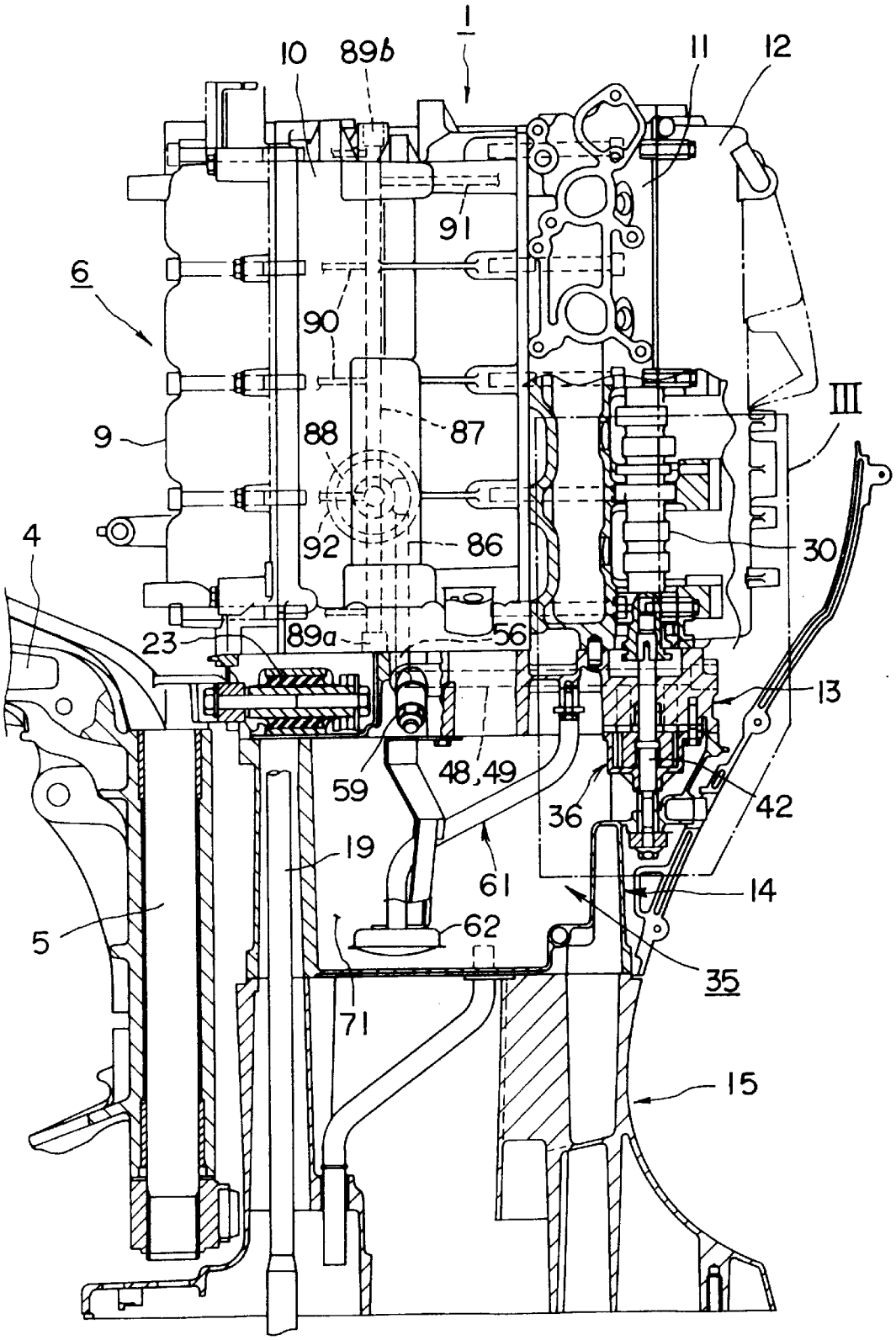
FIG. 2 is a diagram showing a left side surface of an engine of the outboard motor and vertical cross sections of an engine holder, an oil pan and a drive shaft housing of the engine.

An engine 6 mounted in the uppermost portion of the outboard motor 1 is, for example, an in-line, four-cylinder, water-cooled and four-stroke-cycle gasoline engine. The engine 6 is mounted vertically in such a manner that a crank shaft 7 of the engine 6 is positioned vertically. As shown in FIG. 2, the engine 6 is assembled in such a manner that a crank case 9, a cylinder block 10, a cylinder head 11, a head cover 12 and the like are disposed sequentially in the longitudinal direction.

An oil pan 14 is secured to the lower portion of the engine 6 through an engine holder 13 formed into a thick plate-like shape. A drive shaft housing 15 is secured to the lower portion of the oil pan 14, and a gear housing 16 is secured to the lower portion of the drive shaft housing 15.

The engine 6, the engine holder 13 and the oil pan 14 are covered with an engine cover 18 which can be sectioned vertically. The engine cover 18 has a lower cover section 18*a* secured so as to spread over the engine holder 13 and the oil pan 14, and an upper cover section 18*b* detachably attached above the lower cover section 18*a*. When maintenance of the engine 6 or the like is performed, the upper cover section 18*b* is removed.

A drive shaft 19 extending downwards is connected to be integrally rotatable to the lower end of the crank shaft 7 of the engine 6. The drive shaft 19 extends through the engine holder 13, the oil pan 14 and the drive shaft housing 15 and reaches the inside portion of the gear housing 16.

On the other hand, a propeller shaft 20 extending longitudinally is supported in the gear housing 16, and a propeller 21 is connected to be integrally rotatable to the rear end of the propeller shaft 20. A bevel gear mechanism 22 disposed at the intersection between the drive shaft 19 and the propeller shaft 20 transmits rotations of the drive shaft 19 to the propeller shaft 20 so as to rotate the propeller 21.

Further, it is to be noted that a pair of right and left mounting portions 23 and 24 are formed in the front ends of the engine holder 13 and the drive shaft housing 15. The vertical mounting portions 23 and 24 are pivotally supported at the upper and lower ends of the swivel shaft 5.

An air intake unit 26 is attached to the left side surface of the engine 6. A starter motor 27 for starting the engine 6 is mounted on the front surface of the engine 6. The upper end of the crank shaft 7 projects upwards over the upper surface of the engine 6. A flywheel 28 is disposed to be integrally rotatable at the upper end of the crank shaft 7, while a drive pulley 29 is disposed below the flywheel 28.

On the other hand, a cam shaft 30 is pivotally disposed in the cylinder head 11 to be in parallel to the crank shaft 7. An upper end of the cam shaft 30 projects over the upper surface of the engine 6. A driven pulley 31 is attached to the projecting portion to be rotatable.

A timing belt 32 is arranged between the drive pulley 29 of the crank shaft 7 and the driven pulley 31 of the cam shaft 30. The timing belt 32 transmits rotations of the crank shaft 7 to the cam shaft 30 so that a valve moving mechanism, not shown, accommodated in the cylinder head 11 is operated.

A flange-shaped ring gear 28*a* is disposed around the flywheel 28 so that a pinion gear 27*a* of the starter motor 27 projects upwards to be engaged with the ring gear 28*a* when the starter motor 27 has been rotated. As a result, the crank shaft 7 is rotated so as to start the operation of the engine 6.

A cover 33 made of synthetic resin or the like covers the starter motor 27, the flywheel 28, the drive pulley 29, the driven pulley 31, the timing belt 32 and the like from an upper side thereof so that water drops are blocked by the cover 33 to thereby protect the inside portion from water.

The outboard motor 1 is provided with a lubricating device 35 according to the present invention to lubricate the inside portion of the engine 6. The lubricating device 35 is a device for sucking oil accumulated in the oil pan 14 by an oil pump 36 to supply oil into the engine 6. The structure of the lubricating device 35 will be described hereunder.

Figure 3:
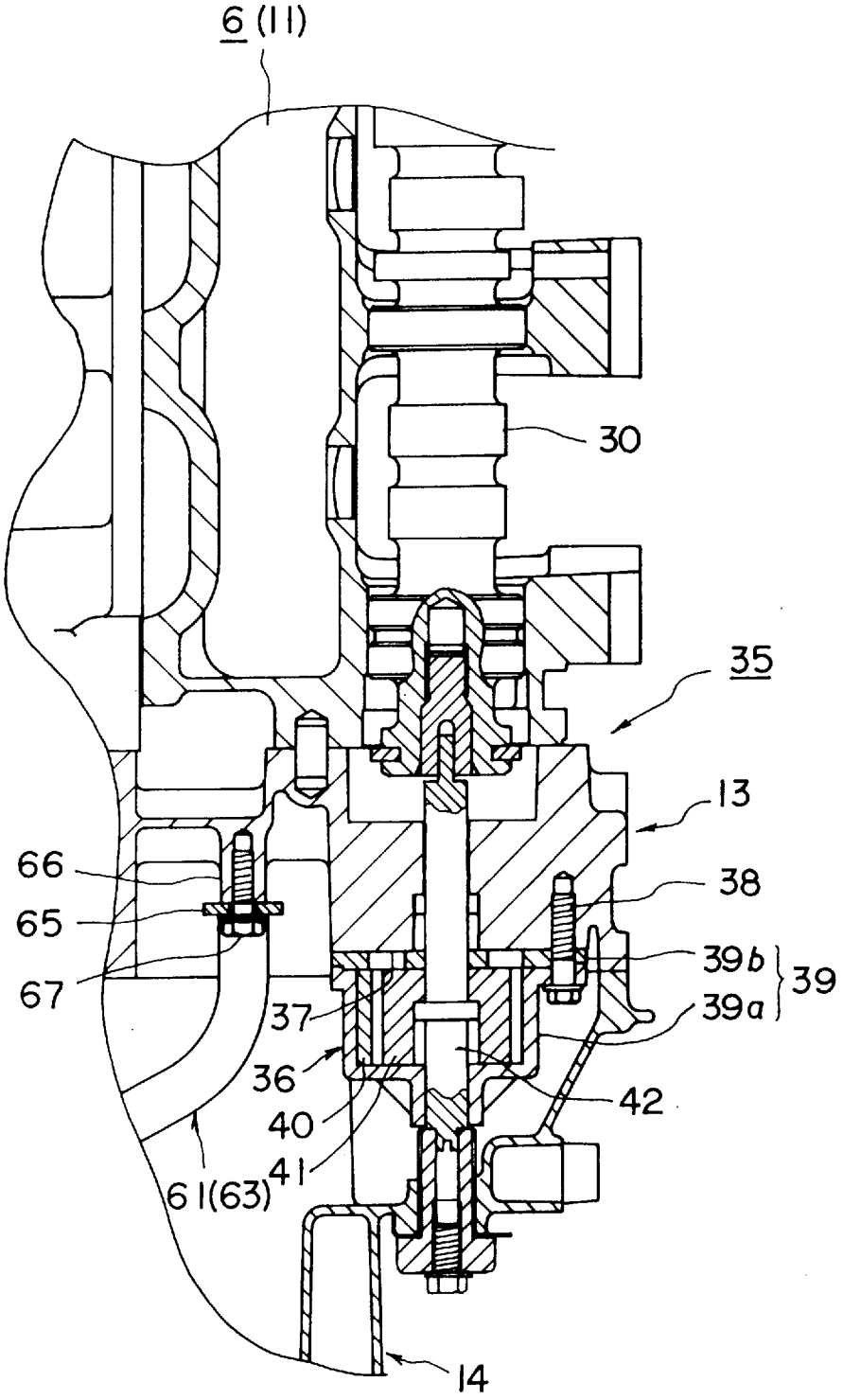
FIG. 3 is an enlarged view of portion III shown in FIG. 2.

As shown in FIGS. 1 to 5, the oil pump 36 is mounted to the rearmost portion of the lower surface of the engine holder 13. As shown in FIGS. 3 and 6, a flat pump mounting portion 37 is formed to the rearmost portion of the lower surface of the engine holder 13. The oil pump 36 is secured to the pump mounting portion 37 by means of three bolts 38.

Figure 7:
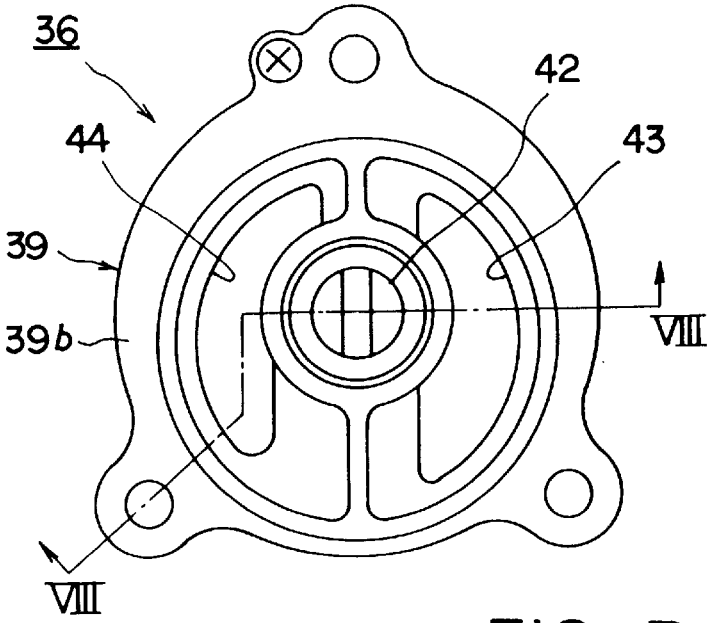
FIG. 7 is a top view showing the oil pump.
Figure 8:
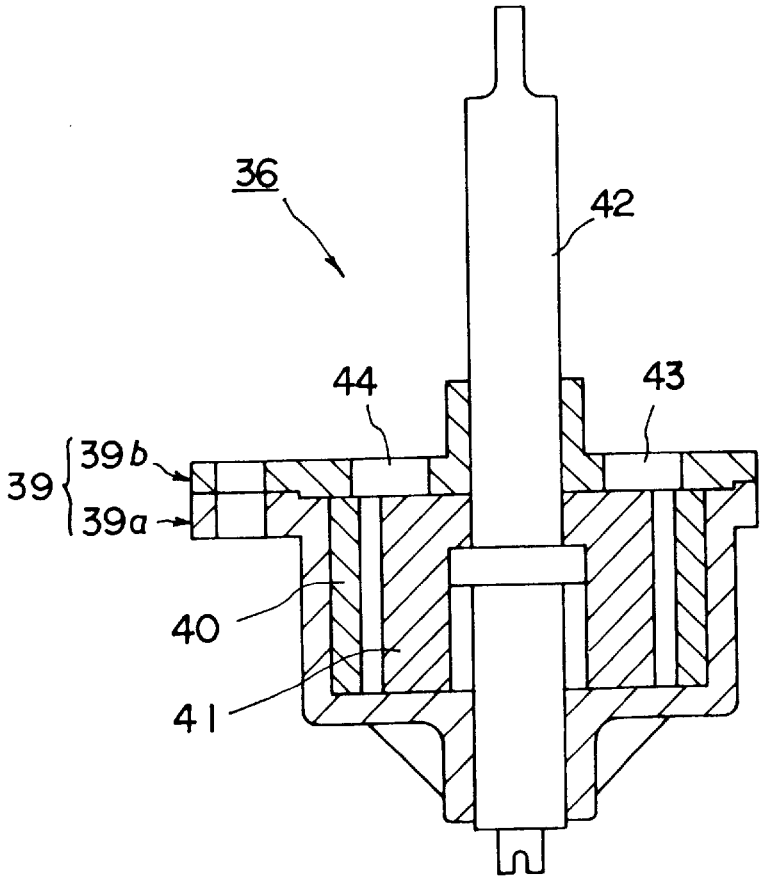
FIG. 8 is a vertical cross sectional view showing the oil pump taken along line VIII—VIII shown in FIG. 7.

As shown in FIGS. 7 and 8 in an enlarged manner, the oil pump 36 is, for example, a usual trochoid pump, which comprises a pump case 39 composed of a case body 39*a* formed into a cup-like shape opened upwards and a flat case cap 39*b*, an outer rotor 40, an inner rotor 41 and a drive shaft 42 arranged to be accommodated in the pump case 39.

Both of the case body 39*a* and the case cap 39*b* of the pump case 39 are clamped to the pump mounting portion 37 of the engine holder 13 with the bolts 38. The drive shaft 42 vertically penetrates the pump case 39, and the inner rotor 41 is integrally disposed at an intermediate portion of the drive shaft 42 to be rotatable. The outer rotor 40 is made to be eccentric from the inner rotor 41. An external gear, not shown, formed on the outer surface of the inner rotor 41 is engaged to the inner surface of an internal gear, not shown, formed on the inner surface of the outer rotor 40.

A crescent-shaped suction port 43 and a crescent-shaped discharge port 44 are formed in the case cap 39*b* in such a way as to oppose to each other across the drive shaft 42. Crescent-shaped suction opening 45 and discharge opening 46 are formed in the pump mounting portion 37 of the engine holder 13 to correspond respectively to the suction port 43 and the discharge port 44. The top end of the drive shaft 42 projects over the upper surface of the engine holder 13 and integrally rotatably and separably connected to the lower end of the cam shaft 30 of the engine 6.

On the other hand, an oil suction passage 48 and an oil discharge passage 49 extending from the oil pump 36 are integrally formed in the engine holder 13, as shown in FIGS. 1, 5, 6 and 9. The oil suction passage 48 is formed so as to extend forward from the rear end of the engine holder 13 on the left side of the drive shaft 42 of the oil pump 36 as viewed in a plan view.

The oil discharge passage 49 is an L-shaped passage formed by joining a first discharge passage 49*a* extending forward from the rear end of the engine holder 13 on the right side of the drive shaft 42 of the oil pump 36 and a second discharge passage 49*b* extending leftward from the right side of the engine holder 13 as viewed in a plan view. As described above, the oil suction passage 48 and the first discharge passage 49*a* of the oil discharge passage 49 are formed in parallel to each other in such a way that the drive shaft 42 of the oil pump 36 is interposed between the oil suction passage 48 and the first discharge passage 49*a*.

When the engine holder 13 is manufactured through a casting process, two parallel thick-wall portions 50 and 51 extending longitudinally and one thick-wall portion 52 extending horizontally as shown in FIG. 6 are previously formed, for example. The oil suction passage 48 and the first and second discharge passages 49*a* and 49*b* of the oil discharge passage 49 are, by drill cutting from rear end and the right side of the engine holder 13, formed to penetrate the central axes of the thick-wall portions 50, 51 and 52. After the oil passages 48, 49*a* and 49*b* have been formed, their outer opened portions are closed by plugs 53*a*, 53*b* and 53*c*. The suction opening 45 and the discharge opening 46 of the pump mounting portion 37 are allowed to communicate with the oil suction passage 48 and the first discharge passage 49*a*, respectively. The oil suction passage 48 is shorter than the first discharge passage 49*a* of the oil discharge passage 49. A strainer port 55 opened in the lower surface of the engine holder 13 is connected to the leading end of the oil suction passage 48.

Figure 9:
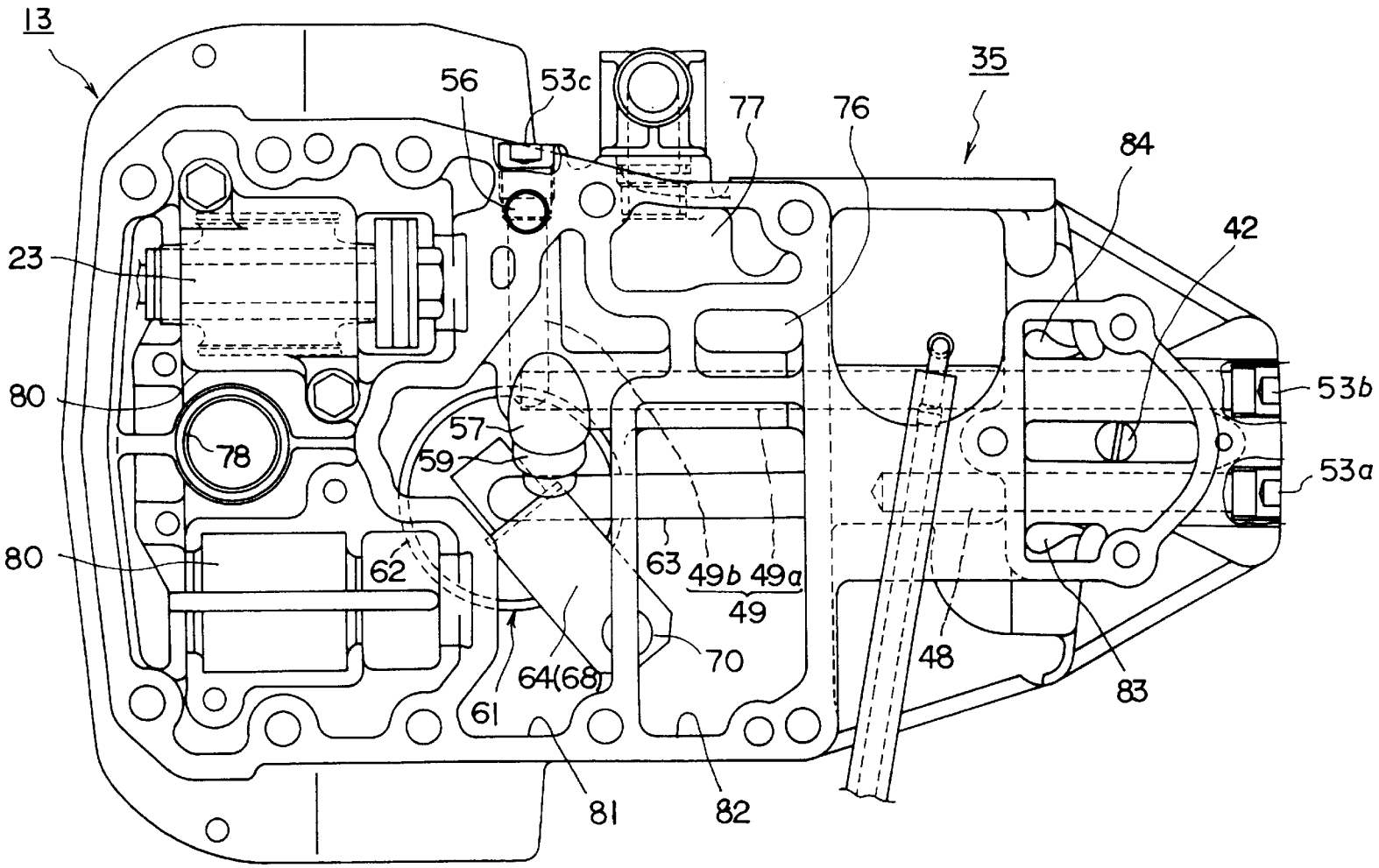
FIG. 9 is a top view showing the engine holder.

Further, as shown in FIG. 9, a short outlet port 56 opened in the upper surface of the engine holder 13 is allowed to communicate with a portion adjacent to the outer end of the second discharge passage 49*b*.

Moreover, as shown in FIG. 6, an oil-pressure control valve mounting portion 57 is formed on the lower surface of the engine holder 13. An oil-pressure control valve passage 58 formed in the central portion of the oil-pressure control valve mounting portion 57 and having a short length is allowed to communicate with the first discharge passage 49*a* and the second discharge passage 49*b* of the oil discharge passage 49. An oil-pressure control valve 59 is attached to the oil-pressure control valve mounting portion 57. Since the oil-pressure control valve mounting portion 57 is formed so as to have an inclination, for example, diagonally downward to the left side, the oil-pressure control valve 59 is also inclined diagonally downwards to the left. As a result, the lower end of the oil-pressure control valve 59 can be prevented from projecting over a joint surface 13*a* (see FIG. 4) of the lower portion of the engine holder 13.

An oil strainer 61 is connected to the strainer port 55 which constitutes the inlet portion of the oil suction passage 48, and the oil strainer 61 is secured to the lower surface of the engine holder 13. The oil strainer 61 is composed of a strainer portion 62 serving as an oil inlet port, a strainer pipe 63 extending upward and warped into an S-shape, and a support leg 64 formed by plate working and extending upward from the strainer portion 62.

Figure 4:
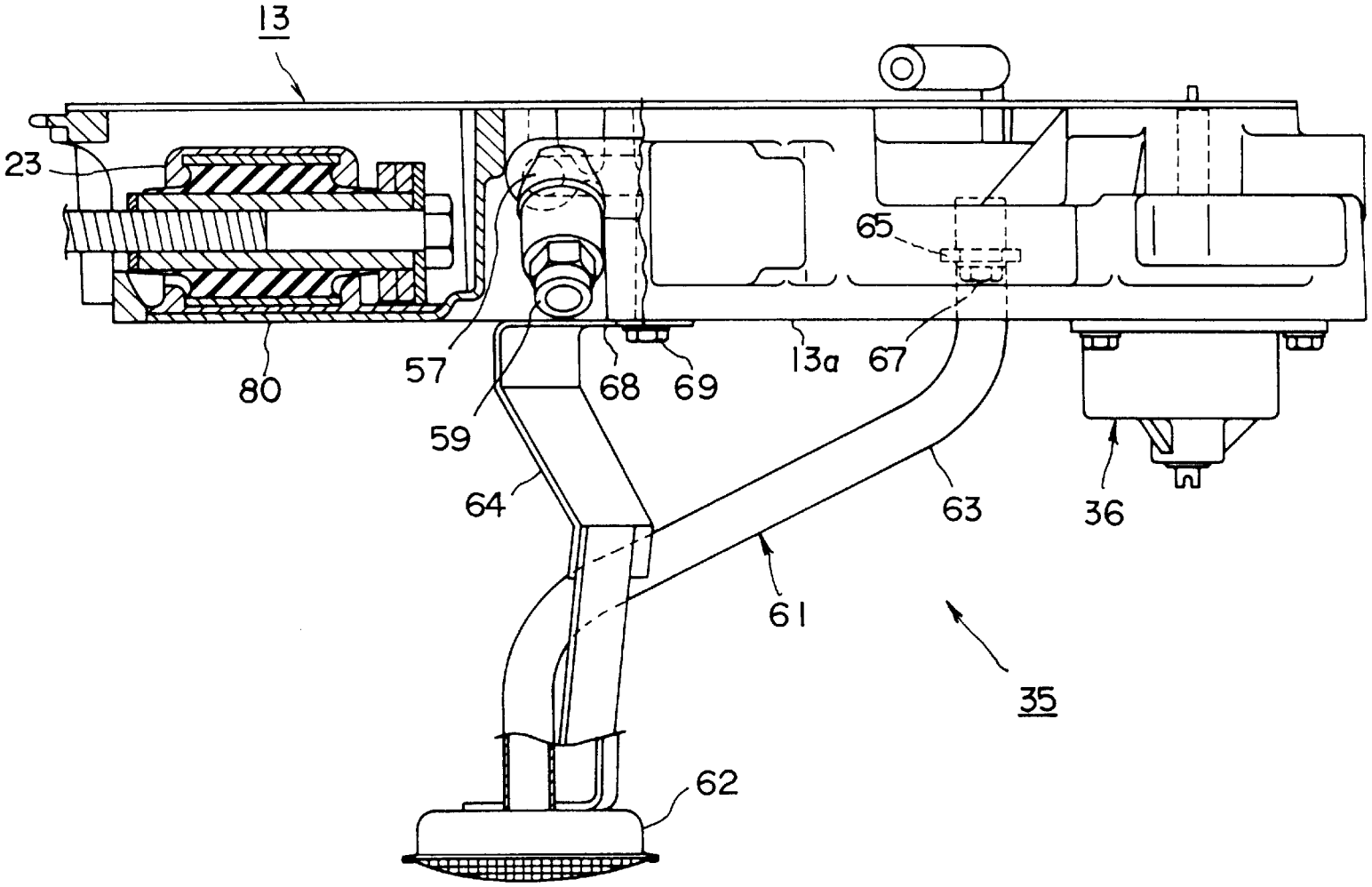
FIG. 4 is a left side view showing the engine holder, an oil pump and an oil strainer.
Figure 5:
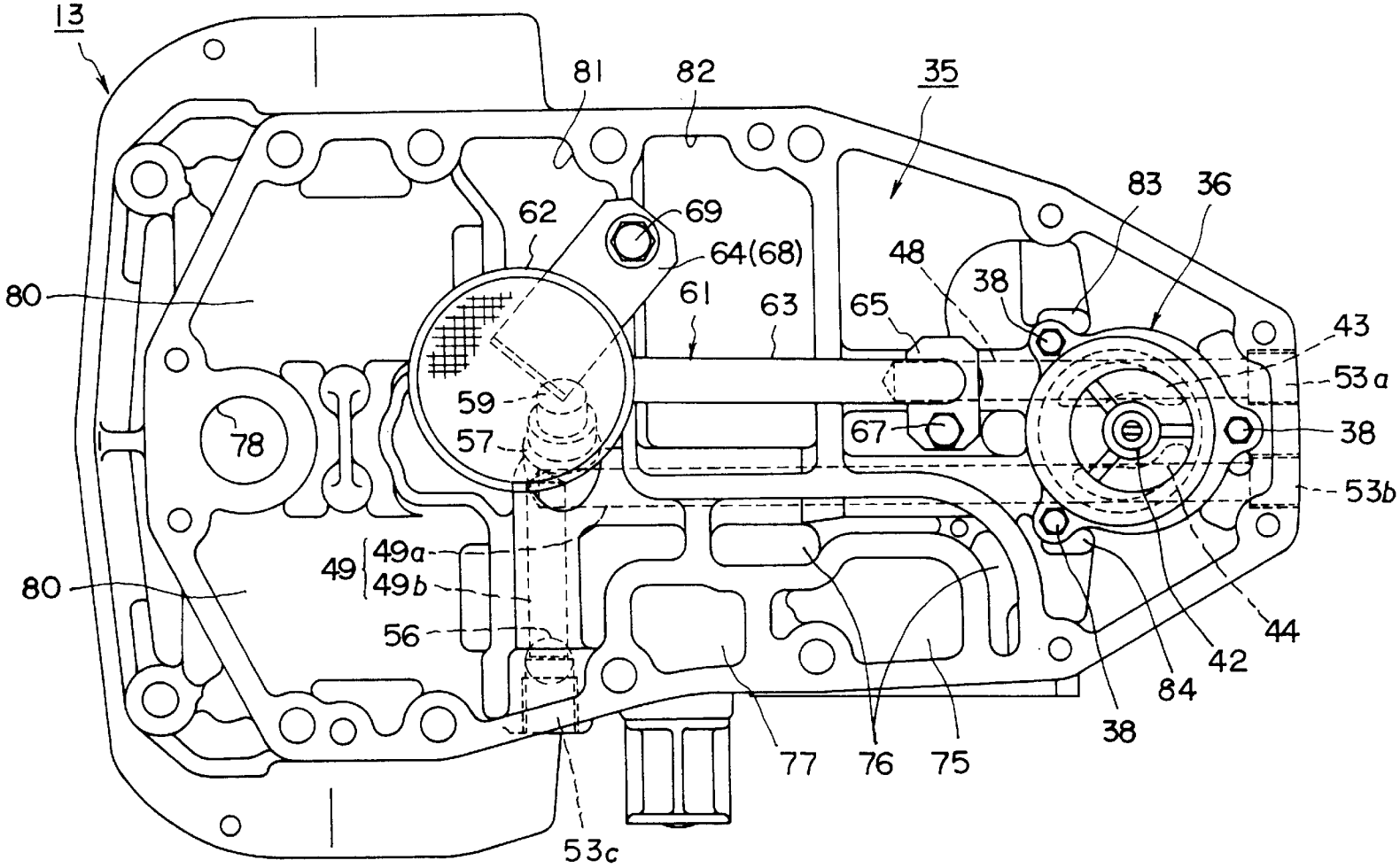
FIG. 5 is a bottom view showing the engine holder to which the oil pump and the oil strainer are attached.
Figure 6:
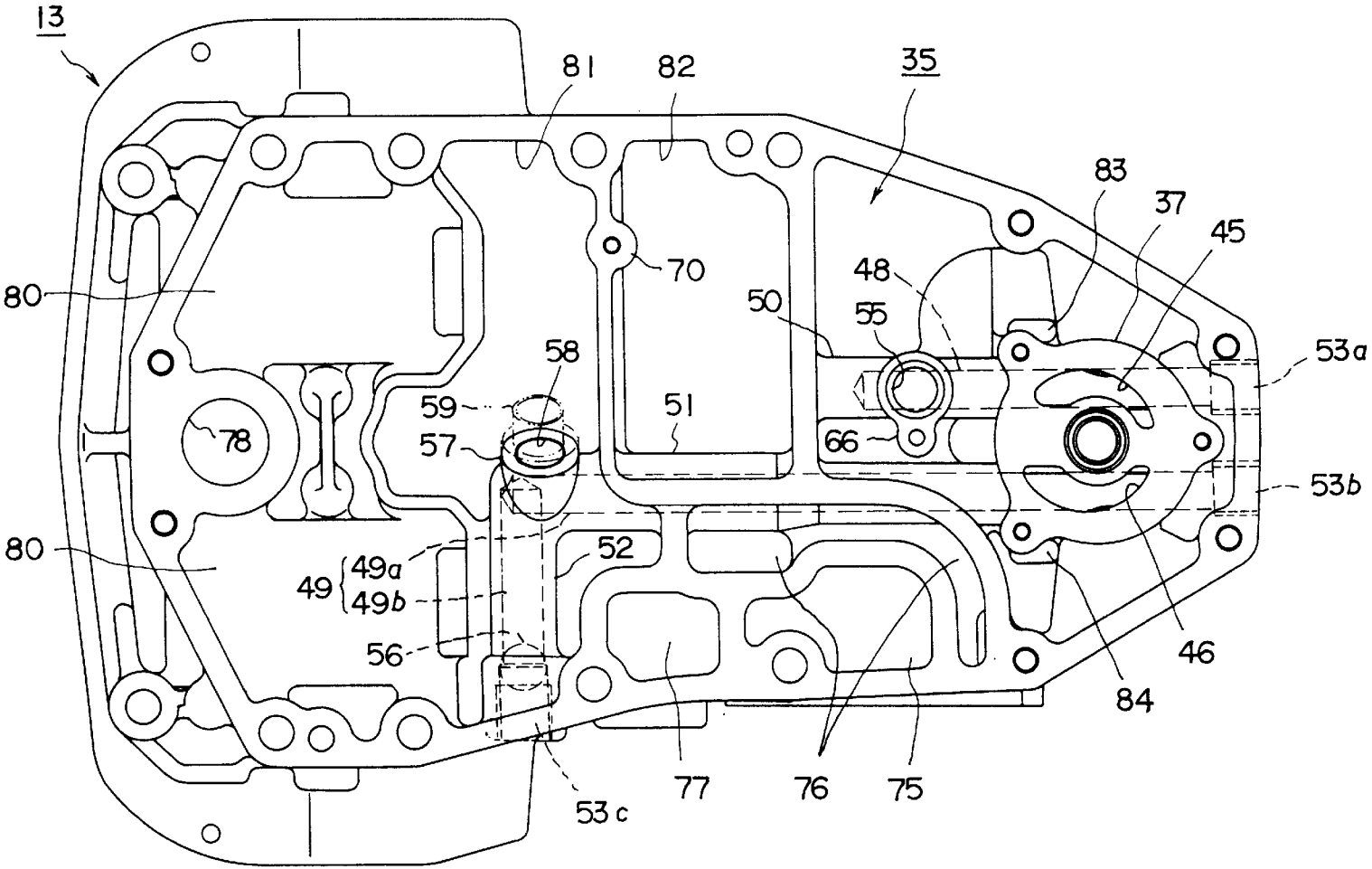
FIG. 6 is a bottom view showing the engine holder from which the oil pump and the oil strainer have been removed.

As shown in FIGS. 3 to 5, a fixing plate 65 is secured to the top end of the strainer pipe 63. The fixing plate 65 is clamped to the strainer clamping portion 66, formed in the side portion of the strainer port 55 shown in FIG. 6, with bolts 67 so that the top end of the strainer pipe 63 is connected to the strainer port 55.

As shown in FIGS. 4, 5 and 9, a fixing member 68 bent and extended horizontally is formed at the top end of the support leg 64, and the fixing member 68 is clamped to a strainer clamping portion 70 formed on the lower surface of the engine holder 13 with bolt 69. As a result, the strainer portion 62 is suspended from the lower portion of the engine holder 13.

The fixing member 68 horizontally extends from the strainer clamping portion 66 to a position below the oil-pressure control valve 59 and serves as a portion for preventing the oil-pressure control valve 59 from being separated. Even if the oil-pressure control valve 59 is loosen attributable to vibrations of the engine or the like, the oil-pressure control valve 59 is brought into contact with the fixing member 68 positioned just below the oil-pressure control valve 59. Therefore, the removal of the oil-pressure control valve 59 can be prevented.

Figure 10:
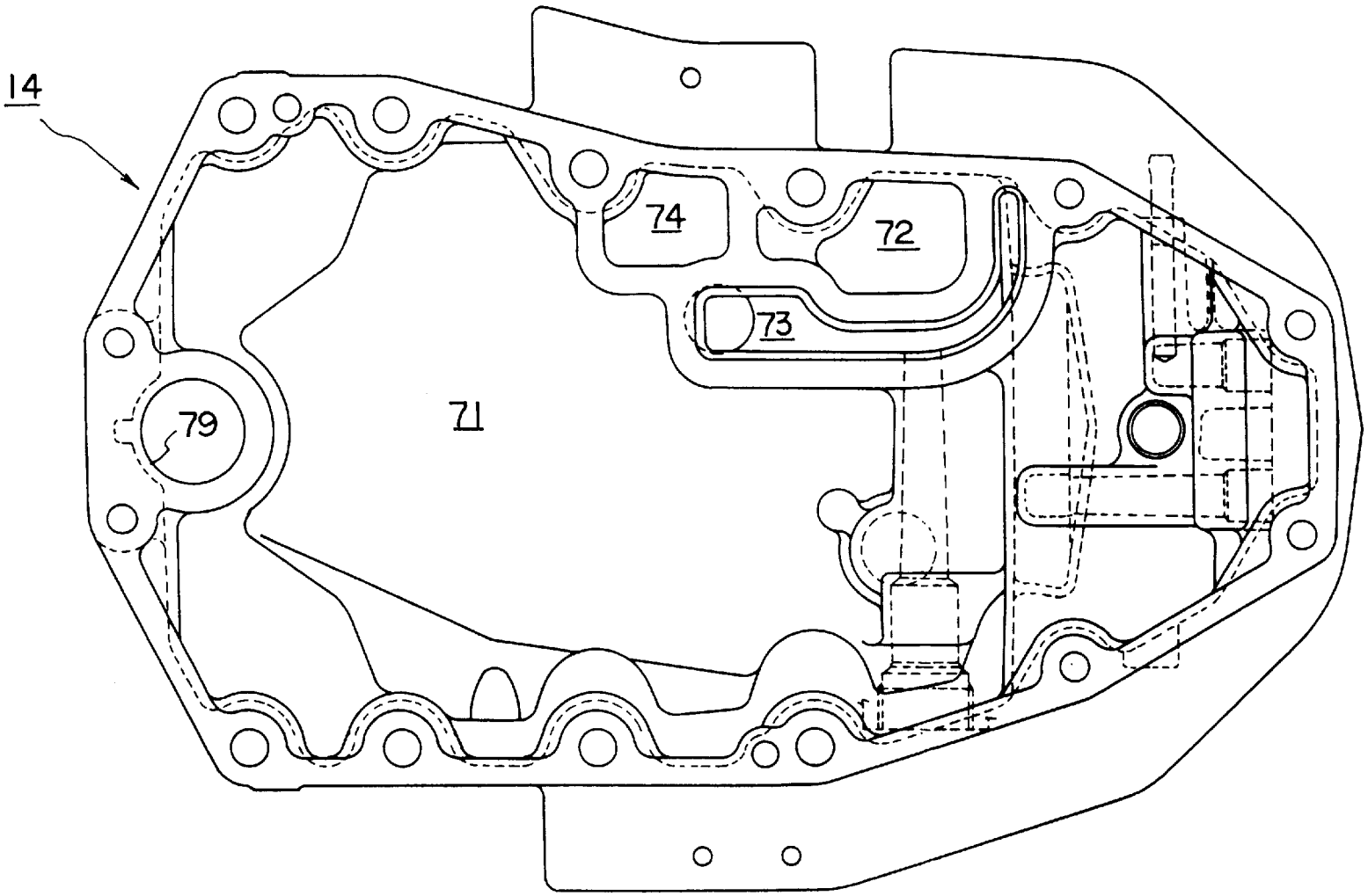
FIG. 10 is a top view showing the oil pan.

FIG. 10 is a top plan view of the oil pan 14. The major portion of the inner space of the oil pan 14 is occupied by an oil accumulation tank 71 which is filled with oil. When the oil pan 14 is secured to the lower surface of the engine holder 13, the strainer portion 62 of the oil strainer 61 is positioned on the bottom surface of the oil accumulation tank 71 (see FIG. 2).

An exhaust passage 72, a water-supply passage 73 and a water-drainage passage 74 are integrally formed in the right-hand portion in the oil pan 14. The passages 72, 73 and 74 are passages extending downwards from the engine 6 and vertically penetrating the inside portion of the oil pan 14. As shown in FIGS. 5, 6 and 9, an exhaust opening 75, a water-supply opening 76 and a water-drainage opening 77 are formed in the engine holder 13, corresponding respectively to the exhaust passage 72, the water-supply passage 73 and the water-drainage passage 74 of the oil pan 14.

Drive shaft insertion openings 78 and 79 through which the drive shaft 19 is inserted are formed in the front end portions of the engine holder 13 and the oil pan 14. Moreover, a pair of right-hand and left-hand mount-receive portions 80, 80 are formed in the front portion of the engine holder 13. The mounting portion 23 is attached to the mount-receive portions 80, 80.

The engine holder 13 has two bore-shaped oil returning passages 81 and 82 formed longitudinally and integrally with the left-hand portion of the central portion thereof and a pair of right-hand and left-hand small-bore-shaped oil returning passages 83 and 84 formed adjacent to the pump mounting portion 37 and integrally with the engine holder 13. The oil returning passages 81 to 84 are passages for returning oil supplied into the inside portion of the engine 6 to the oil accumulation tank 71 of the oil pan 14.

As shown in FIG. 2, the cylinder block 10 of the engine 6 has an oil supply passage 86 formed longitudinally and a main oil gallery 87 formed in parallel to the oil supply passage 86. The oil supply passage 86 is formed so as to correspond to the outlet port 56 of the oil discharge passage 49 (the second discharge passage 49*b*) formed in the engine holder 13. The upper end of the oil supply passage 86 is connected to an oil filter mounting portion 88 formed on the right side surface of the cylinder block 10.

The main oil gallery 87 is formed to vertically penetrate the cylinder block 10, the main oil gallery 87 being formed perpendicular to the oil filter mounting portion 88. The upper and lower opened portions of the main oil gallery 87 are closed by plugs 89*a* and 89*b*. A bearing oil passage 90 connected to a bearing portion of the crank shaft 7 and a head oil passage 91 extending to the inside portion of the cylinder head 11 and connected to a bearing portion of the cam shaft 30, and a valve moving unit, are branched from the main oil gallery 87.

An oil filter 92 is exchangeably provided for the oil filter mounting portion 88 and the oil supply passage 86 is allowed to pass through the inside portion of the oil filter 92 and then connected to the main oil gallery 87.

The operation of the lubricating device 35 having the above-mentioned structure will be described hereunder.

When the engine 6 of the outboard motor 1 has been started, the cam shaft 30 is rotated, thus causing the oil pump 36 to be operated. Therefore, oil accumulated in the oil accumulation tank 71 of the oil pan 14 flows in the sequential order as the oil strainer 61, the oil suction passage 48, the oil pump 36, the oil discharge passage 49, the outlet port 56, the oil supply passage 86, the oil filter 92 and the main oil gallery 87. Thus, oil is supplied to the engine 6 so as to lubricate the inside portion of the engine 6.

Oil, which has lubricated the inside portion of the engine 6, then flows downward in the engine 6 and returns to the oil accumulation tank 71 of the oil pan 14. A portion of oil, which has been supplied to the inside portions of the crank case 9 and the cylinder block 10, is allowed to flow through the oil returning passages 81 and 82 of the engine holder 13, and then returned to the oil accumulation tank. Furthermore, a portion of oil, which has been supplied into the inside of the cylinder head 11, is allowed to flow through the oil returning passages 83 and 84 of the engine holder 13 and then returned to the oil accumulation tank 71.

If the oil discharging pressure of the oil pump 36 is raised excessively, the oil-pressure control valve 59 provided for the oil discharge passage 49 is opened, so that excessive oil is returned to the oil accumulation tank. Therefore, the pressure in the oil passages following the oil-pressure control valve 59 is not raised excessively, preventing the oil from leaking.

Figure 11:
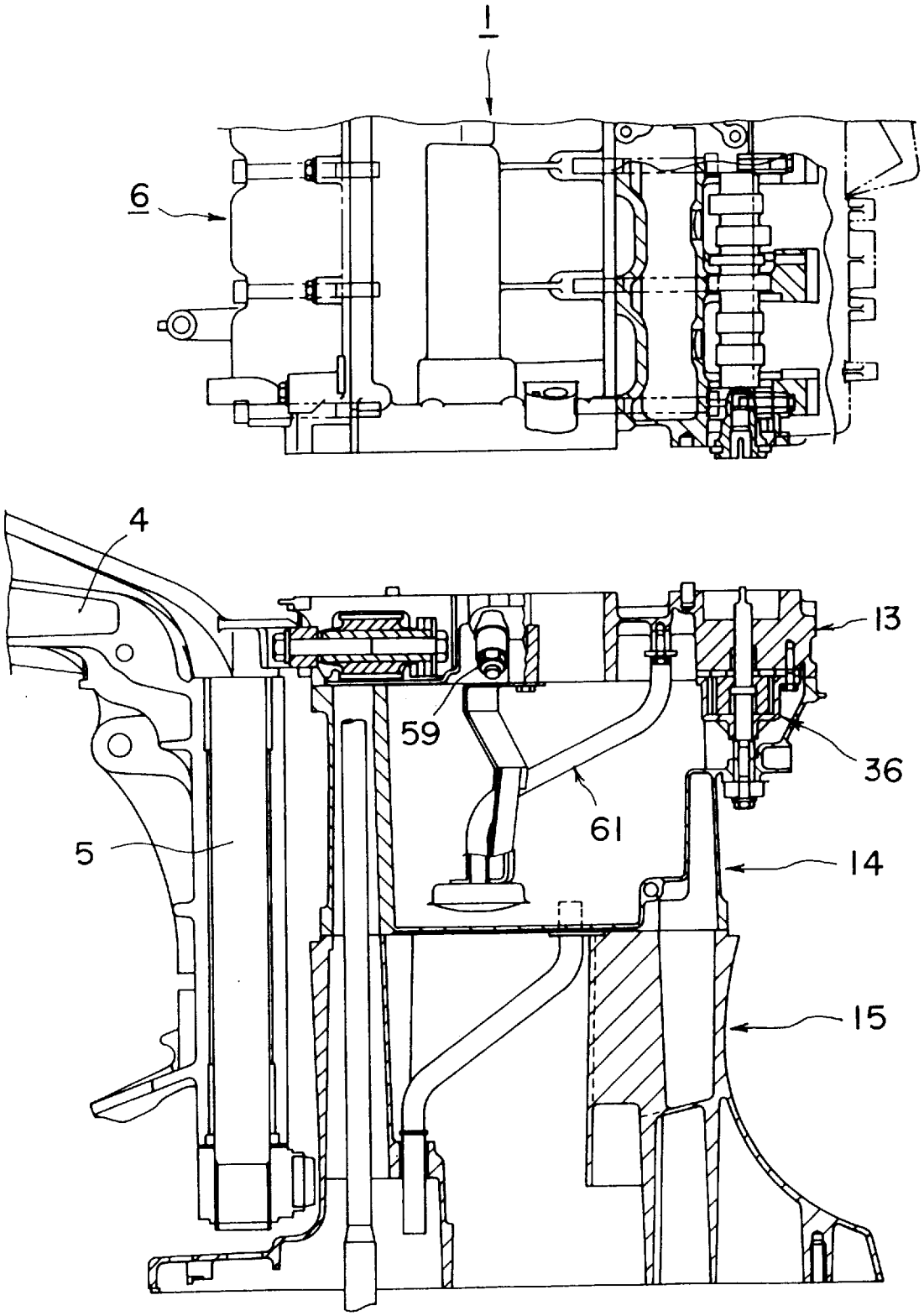
FIG. 11 is a diagram showing a state where the engine is solely separated from the outboard motor.

Since the lubricating device 35 having the above-mentioned structure is arranged in such a manner that the oil pump 36 is disposed adjacent to the lower surface of the engine holder 13 which is secured to the lower portion of the engine 6, the oil pump 36 is left in the engine holder 13 when the engine 6 is solely separated from the outboard motor 1, as shown in FIG. 11.

Therefore, since the oil pump 36 does not project over the lower surface of the engine 6, there is no apprehension of the breakage of the oil pump 36 attributable to an external factor. In addition, the engine 6 can be placed on a flat workbench when maintenance of the engine 6 is performed. Thus, the maintenance of the engine 6 can significantly easily be performed. Moreover, even if the engine 6 is removed, the oil pump 36 is left in the oil pan 14, and therefore, drying of the oil pump 36 and introduction of foreign matter into the oil pump 36 can be prevented, whereby the life of the oil pump 36 can be elongated.

Furthermore, since the oil suction passage 48 and the oil discharge passage 49 extending from the oil pump 36 are integrally formed in the inside portion of the engine holder 13, it becomes not necessary to form the oil passages 48 and 49 in the cylinder head and the cylinder block of the engine as has been required for the conventional structure. Therefore, the manufacturing easiness of the engine 6 can significantly be improved. In addition, the size of the engine holder 13 is not substantially enlarged despite the provision of the oil suction passage 48 and the oil discharge passage 49, reducing the size and weight of the engine 6.

Moreover, the oil suction passage 48 and the first discharge passage 49*a* of the oil discharge passage 49 are formed in the engine holder 13 in parallel to each other in such a manner that the drive shaft 42 of the oil pump 36 is interposed between the oil suction passage 48 and the first discharge passage 49*a*, so that the oil suction passage 48 and the first discharge passage 49*a* can significantly easily be formed through a drilling or the like process.

Since both of the oil-pressure control valve 59 and the oil strainer 61 are formed adjacent to the lower surface of the engine holder 13, the oil-pressure control valve 59 and the oil strainer 61 are left in the engine holder 13 after only the engine 6 has been removed from the outboard motor 1 as shown in FIG. 11. Therefore, breakage of the oil-pressure control valve 59 and the oil strainer 61 attributable to an external factor can be prevented. Since the oil-pressure control valve 59 and the oil strainer 61 are not required to be removed when the engine 6 is removed, the removing operation can easily be performed.

Furthermore, the oil-pressure control valve 59 is inclined on the lower surface of the engine holder 13 (see FIG. 4) in such a manner that the oil-pressure control valve 59 does not project over the joint surface 13*a* in the lower portion of the engine holder 13. Therefore, the engine holder 13 can be placed on a flat workbench by removing only the oil pump 36 and the oil strainer 61, whereby the maintenance can easily be performed even if the engine holder 13 is attempted to be solely maintained. Moreover, the oil-pressure control valve 59 is not brought into contact with another object, when the maintenance is performed, so that the oil-pressure control valve 59 is not broken.

Since the oil-pressure control valve 59 is disposed in the seamless oil discharge passage 49 formed integrally with the engine holder 13, leakage of oil from the oil discharge passage 49, in which the pressure is raised to the highest level, can efficiently be prevented.

Since the fixing member 68 formed by bending the support leg 64 of the oil strainer 61 also serves as a portion for preventing separation of the oil-pressure control valve 59, the separation of the oil-pressure control valve 59 can be prevented by the fixing member 68 even if the oil-pressure control valve 59 is loosened. Therefore, the oil pressure is not lowered and the lubricating device 35 is able to always be operated normally with a simple structure.

Still furthermore, since the bore-shaped oil returning passages 81 to 84 for returning oil supplied into the engine 6 to the oil pan 14 are integrally formed with the engine holder 13, it becomes not necessary to form the oil returning passage in the cylinder head and the cylinder block of the engine, as has been required for the conventional outboard motor. Therefore, the oil can quickly be returned to the oil pan 14 with a simple internal structure of the engine 6.

As described above, the lubricating device for an outboard motor according to the present invention is structured in such a manner that the oil pump is disposed on the lower surface of the engine holder, and the oil suction passage and the oil discharge passage extending from the oil pump are formed integrally with each other in the engine holder. Therefore, breakage of the oil pump can be prevented when the engine is solely removed from the outboard motor. Moreover, maintenance of the engine can easily be performed. In addition, drying of the oil pump and introduction of foreign matter into the oil pump can be prevented after the engine has been removed to elongate the life of the oil pump, easily manufacture the engine and reduce the size of the engine.

It is to be noted that the present invention is not limited to the described preferred embodiment and many other changes and modifications may be made without departing from the scope of the appended claims.

What is claimed is:

1. A lubricating device for an outboard motor in which an engine is vertically mounted so that a crank shaft of the engine is disposed vertically, an engine holder and an oil pan are secured to a lower portion of the engine, and an oil accumulated in the oil pan is supplied to the engine, said lubricating device comprising an oil pump mounted to a lower side portion of the engine holder in an installed state of the outboard motor and adapted to suck the oil accumulated in the oil pan, an oil suction passage and an oil discharge passage, said oil suction passage and oil discharge passage extending from said oil pump and being formed integrally with an inside portion of the engine holder.

2. A lubricating device for an outboard motor according to claim 1, wherein said oil suction passage and said oil discharge passage are disposed in parallel to each other in the engine, said oil pump having a drive shaft extending outward between the oil suction passage and the oil discharge passage.

3. A lubricating device for an outboard motor according to claim 1, wherein said oil suction passage has an inlet portion connected to an oil strainer which is secured to the lower surface of the engine holder.

4. A lubricating device for an outboard motor according to claim 3, wherein an oil-pressure control valve is provided for said oil discharge passage, said oil-pressure control valve being disposed on the lower surface of the engine holder in an inclined manner so as to prevent the oil-pressure control valve from projecting over a joint surface which is the lower surface of the engine holder.

5. A lubricating device for an outboard motor according to claim 4, wherein said oil strainer has a support leg, which is bent to prevent the oil-pressure control valve from falling down.

6. A lubricating device for an outboard motor according to claim 1, wherein said engine holder is integrally formed with a bore-shaped oil returning passages for returning the oil supplied into the inside portion of the engine to the oil pan.

7. An outboard motor comprising:

an engine of vertical type in which a crank shaft is disposed vertically in an installed state of the engine;

an engine holder supporting the engine;

an oil pan which is disposed below the engine through the engine holder and in which an oil is accumulated; and a lubricating device for lubricating the oil from the oil pan to an inside of the engine, said lubricating device comprising an oil pump mounted to a lower side portion of the engine holder and adapted to suck the oil accumulated in the oil pan, an oil suction passage and an oil discharge passage, said oil suction passage and oil discharge passage extending in parallel to each other from said oil pump and being formed integrally with an inside portion of the engine holder.

* * * * *